US008277081B2

(12) United States Patent
Song et al.

(10) Patent No.: US 8,277,081 B2
(45) Date of Patent: Oct. 2, 2012

(54) LAMP USING LED

(75) Inventors: Kyu Seop Song, Daejeon (KR); Kwang Soo Kim, Daejeon (KR); Young Hoon An, Wonju-si (KR)

(73) Assignee: APACK, Inc., Daejeon (KR)

( * ) Notice: Subject to any disclaimer, the term of this patent is extended or adjusted under 35 U.S.C. 154(b) by 237 days.

(21) Appl. No.: 12/868,272

(22) Filed: Aug. 25, 2010

(65) Prior Publication Data

US 2011/0235329 A1 Sep. 29, 2011

(30) Foreign Application Priority Data

Mar. 24, 2010 (KR) ..... 10-2010-0026143

(51) Int. Cl.
*F21S 4/00* (2006.01)

(52) U.S. Cl. ..... 362/249.02; 362/294; 362/345; 362/218

(58) Field of Classification Search ..... 362/249.01, 362/249.02, 218, 294, 345
See application file for complete search history.

(56) References Cited

U.S. PATENT DOCUMENTS

| | | | | |
|---|---|---|---|---|
| 8,167,466 | B2 * | 5/2012 | Liu | 362/373 |
| 2007/0081341 | A1 * | 4/2007 | Raos et al. | 362/294 |
| 2010/0302769 | A1 * | 12/2010 | Horng et al. | 362/218 |
| 2011/0069493 | A1 * | 3/2011 | Huang | 362/294 |

* cited by examiner

*Primary Examiner* — Evan Dzierzynski
(74) *Attorney, Agent, or Firm* — The Webb Law Firm

(57) ABSTRACT

Provided is a lamp using LED which has a heat sink and an air-flowing part formed in a body and is equipped with a heat pipe to make higher a heat-conductive efficiency and thereby to make higher a heat-generation performance considerably so that the light emitting diode can be applied to a high-output illumination device to increase a life-time.

7 Claims, 6 Drawing Sheets

LAMP USING LED

CROSS-REFERENCE(S) TO RELATED APPLICATIONS

The present invention claims priority of Korean Patent Application No. 10-2010-0026143, filed on Mar. 24, 2010, which is incorporated herein by reference.

BACKGROUND OF THE INVENTION

1. Field of the Invention

The present invention relates to a lamp using LED; and, more particularly, to a lamp using LED which has a heat sink and an air-flowing part formed in a body and is equipped with a heat pipe to make higher a heat-conductive efficiency and thereby to make higher a heat-generation performance considerably so that the light emitting diode can be applied to a high-output illumination device to increase a life-time.

2. Description of Related Art

The light emitting diode (LED) is an optoelectronic element having a junction structure of P-type and N-type semiconductor to discharge the light of energy corresponding to bandgap of the semiconductor if electrons and holes combine when the power is applied, and it is spotlighted as the lighting means of a high efficiency since a response time is higher compared with the general bulb and the consumed power is lower by 20% compared with the general bulb even when the illuminance is higher.

In a case of using a high-output light emitting diode as a lighting lamp, since a large amount of heat is generated from the light emitting diode module, the heat generated from the light emitting diode module having the junction structure of the semiconductor can reduce the illumination efficiency. Therefore, there is needed a means for discharging the heat generated from the light emitting diode module.

FIG. 1 shows a general light emitting diode illumination device 10, which includes a substrate 1; a light emitting diode module 2 provided in one side of the substrate 1; a heat sink 3 provided in the other side of the substrate 1 for discharging the heat generated from the light emitting diode module 2.

In addition, the prior light emitting diode illumination device 10 includes a sealing means 4 such as a lens which keeps an air-tight seal on the light emitting diode module 2 of the substrate 1 to protect an internal structure while transmitting the light and it can be further equipped with a heat pipe to improve a heat-dissipation efficiency of the heat sink 3.

However, in the prior light emitting diode illumination device having the heat-dissipation structure mentioned-above, a sufficient heat-dissipation performance can not be obtained, which leads to a major cause of decreasing the life time of the light emitting diode module.

The prior light emitting diode illumination device can not transfer the heat effectively since the heat generated from the light emitting diode module is transferred to the heat sink through the substrate, and particularly it has a problem that the heat-transfer efficiency is low since the insulating layer is formed on a top side of the substrate.

Further, since the top side of the substrate is sealed by the sealing means to cause it to be interrupted from the outside air, the heat-dissipation performance is lowered.

Subsequently, in the high-output illumination device such as the lamp, there is needed a scheme for dissipating the heat generated from the light emitting diode module effectively and improving a durability and a life-time higher.

SUMMARY OF THE INVENTION

The present invention is contemplated to resolve the problems mentioned-above, and an object of the present invention is directed to providing a lamp using LED which has an air-flowing part formed in a body and is equipped with a heat pipe to make higher a heat-conductive efficiency and thereby to make higher a heat-generation performance considerably so that the light emitting diode can be applied to a high-output illumination device to increase a life-time.

One embodiment of the present invention is directed to providing a lamp using LED, comprising a substrate in which a plurality of light emitting diodes 110 is disposed at a predetermined distance and which has at least one first hollow-part formed by hollowing a predetermined region so that an air flows through it; a body 200 which has a heat sink 210 provided in one side of the substrate 100 to cause a heat generated from the light emitting diode 110 to be transferred and an air-flowing part 220 hollowed to correspond to the first hollow-part; and a protecting means 300 which is attached to the body 200 in the other side of the substrate 100 to protect the substrate 100 and has a second hollow-part 301 hollowed to correspond to the first hollow-part and the air-flowing part.

Preferably, the lamp using LED 1000 is formed with a holding means 400 which holds the body 200 to cause the air-flowing part 220 to be communicated upward and downward.

Preferably, the air-flowing part 220 is formed with a plurality of hollow holes 221.

Further, the lamp using LED 1000 is formed with a heat pipe 500 which is provided between the body 200 and the substrate 100.

Preferably, the body 200 has a concave-type setting part 230 into which the heat pipe 500 is set.

Preferably, the heat pipe 500 is formed adjacent to the air-flowing part 220.

Preferably, a predetermined area of the heat pipe 500 is located in the air-flowing part 220.

Figure 1:
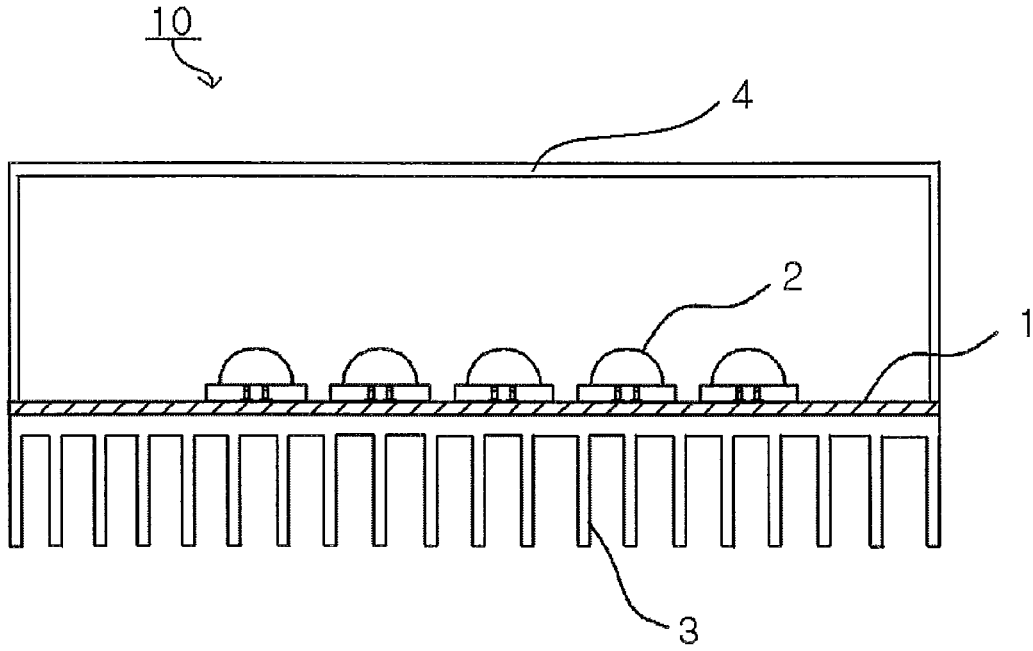
FIG. 1 is a drawing showing a prior light emitting diode illumination device.
Figure 2:
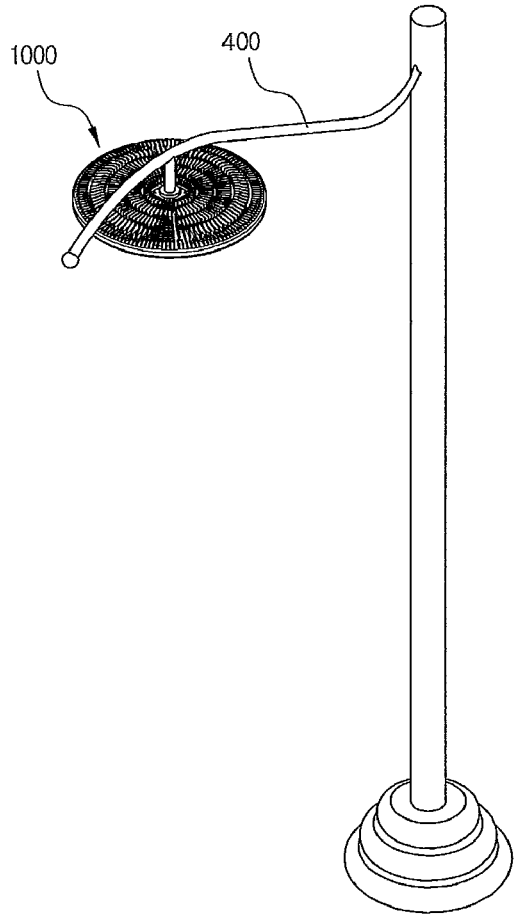
FIG. 2 is a perspective view of the lamp using LED according to the present invention.

| [Detailed Description of Main Elements] | |
|---|---|
| 1000: | lamp using LED |
| 100: | substrate |
| 101: | first hollow-part |
| 110: | light emitting diode |
| 200: | body |
| 210: | heat sink |
| 220: | air-flowing part |
| 230: | setting part |
| 300: | protecting means |
| 301: | second hollow-part |
| 400: | holding means |
| 500: | heat pipe |

DESCRIPTION OF SPECIFIC EMBODIMENTS

The advantages, features and aspects of the invention will become apparent from the following description of the embodiments with reference to the accompanying drawings, which is set forth hereinafter.

The lamp using LED 1000 according to the present invention will be described specifically referring to accompanying drawings.

The lamp using LED 1000 according to the present invention includes a substrate 100, a body 200 and a protecting means 300.

The substrate 100 has the light emitting diodes 110 disposed at a predetermined distance, and can be used with a metal substrate or a printed circuit board which has a pattern for providing a power source to an insulating layer and the light emitting diode formed on a parent metal.

The body 200 is provided on one side of the substrate 100 (a side opposite to the side in which the light emitting diode 110 is provided to radiate the heat), and is formed with a heat sink 210 to which the heat generated from the light emitting diode 110 is transferred to dissipate the heat while supporting the substrate 100 at one side.

For the purpose of it, the body 200 has at least one air-flowing part 220 formed by hollowing a predetermined region so that the air flows through it.

In other words, the air-flowing part 220 is not formed in such a way that an outer peripheral surface of the body 200 is partially changed, but formed in the inside region of the body 200. And the air-flowing part of the air-flowing part 220 has a closed cross-section.

The air-flowing part 220 is to allow the air inside the body 200 to flow through it and to allow the heat generated from the light emitting diode 110 to be dissipated smoothly.

At this time, the air-flowing part 220 can be formed at least one, and one air-flowing part 220 includes a plurality of hollow-holes 221.

Further, the hollow-holes 221 can be formed with a honey-type (octagonal cross-section) to make the air flow easy and make the heat-dissipation performance higher, and formed with polygonal, round, ellipse and the like in addition to it.

The substrate 100 is formed with a first hollow-part 101 having a shape corresponding to a shape of the air-flowing part 220 to make the air flow smooth at the air-flowing part 220 of the body 200.

The protecting means 300 is attached to the body 200 at the other side of the substrate 100 to protect the substrate 100 and the protecting means 300 must be made from transmission-type material to protect the inside structure while passing the light radiated from the light emitting diode 110.

The protecting means 300 is formed with a second hollow-part 301 having a shape corresponding to a shape of the air-flowing part 220 to enable the air to flow through the air-flowing part 220 of the body 200.

The protecting means 300 is preferably provided such that the inside of the body 200 may be kept air-tight at a periphery of the second hollow-part 301 and a periphery of the protecting means 300.

The protecting means 300 for protecting the light emitting diode 110 can conventionally function as an element of reducing the heat-dissipation performance by interrupting the outside air, whereas the lamp using LED 1000 according to the present invention can be applied to high-output illuminating device without a reduction of the heat-dissipation performance since the air-flowing part 220 is formed in the body 200 and the second hollow-part 301 having a shape corresponding to the shape of the air flowing-part 220 is formed in the protecting means 300.

The lamp using LED 1000 according to the present invention has a holding means 400 for holding the body 200 in order to irradiate the light downwardly from a predetermined height.

The holding system 400 can be formed with various materials and various shapes in order to hold the body 200 while enabling the light emitting diode 110 to irradiate the light in a predetermined direction.

At this time, the holding means 400 preferably holds the body 200 to cause the air-flowing part 220 to be communicated in both downward and upward directions.

To allow the air flowing part 220 to be communicated in both downward and upward directions is for the purpose of flowing the air smoothly via the air-flowing part 220 thereby maximizing the cooling performance.

Subsequently, the lamp using LED 1000 according to the present invention has an advantage that the heat generated from the light emitting diode 110 can be dissipated to the outside by causing the air to flow thorough the air-flowing part 220 of the lamp using LED 1000 during upward and downward movement of the air due to the air temperature change.

FIGS. 3 to 6 show that the body 200 is round-shaped and five air-flowing portions 220 are formed with a circular sector (a shape a vertex of the circular sector and a part adjacent to it are omitted) and have a plurality of hollow-holes 221.

Figure 7:
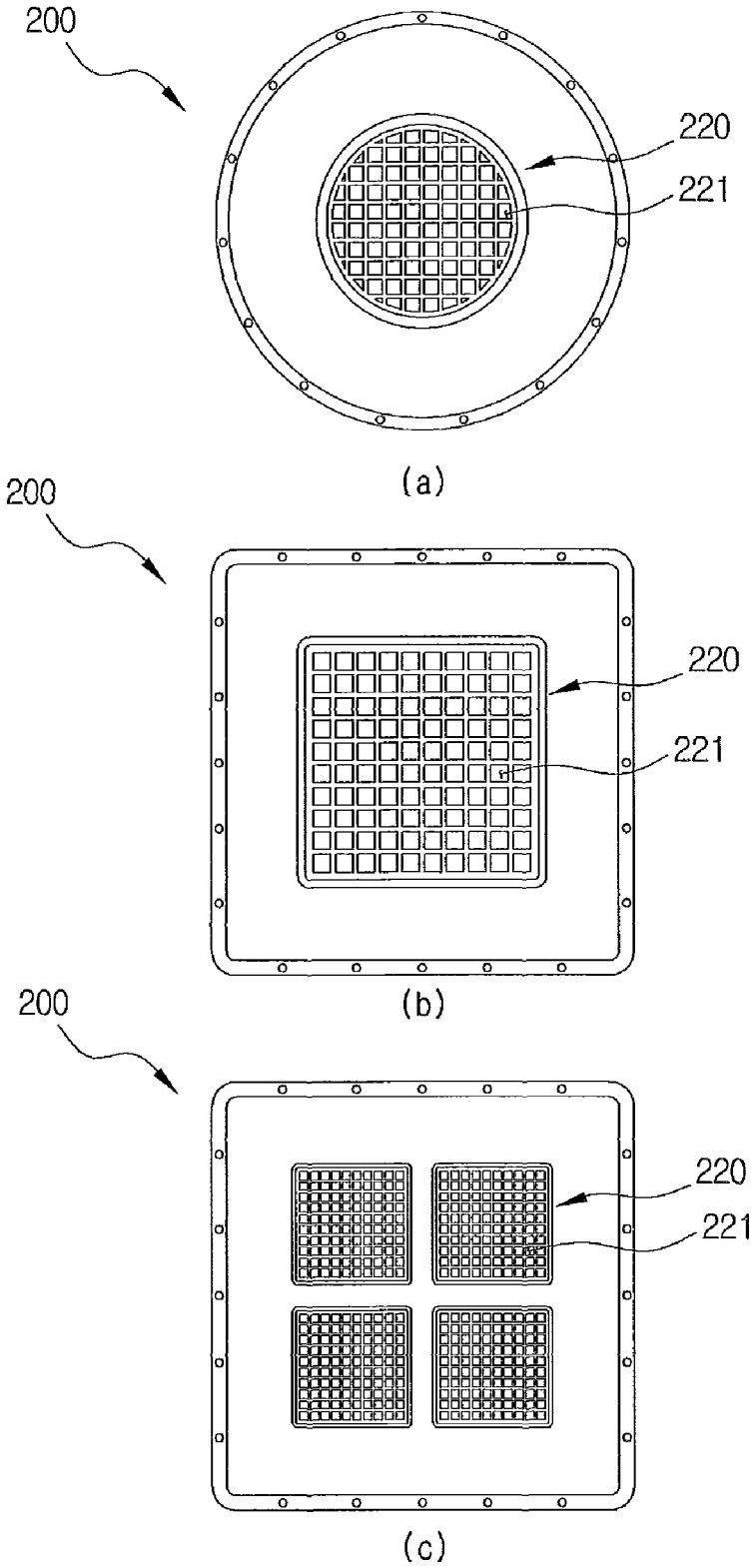
FIG. 7 is a drawing showing still other body type of the lamp using LED according to the present invention.

FIG. 7 is a drawing showing various shapes of the body 200. FIG. 7(*a*) shows an example that the body is round-shaped and the air-flowing part 220 is formed in a center portion to allow the heat in the center part to be cooled, in a case that the body 200 of large area is formed.

FIGS. 7(*b*) and 7(*c*) show examples that the body 200 is approximately rectangular-shaped, in which FIG. 7(*b*) shows an example that the air-flowing part 220 is formed in one region of the center and FIG. 7(*c*) shows an example that the air-flowing portions 220 are formed respectively in four regions.

Besides the examples shown in the Figures, the lamp using LED 1000 according to the present invention can be structured such that a region in which the air-flowing part 220 is formed, and the shape and the number of the hollow-hole 221 are variously changed, considering the environment in which the lamp using LED 1000 is equipped and an amount of heat-dissipation of the light emitting diode 110.

The lamp using LED 1000 according to the present invention can further include a heat pipe 500 between the body 200 and the substrate 100 to improve the heat-dissipation performance.

Particularly, the heat pipe 500 is enabled to make the total temperature distribution even and improve the heat-dissipation performance by enabling the heat of the center to be transferred in a lateral direction, in a case that the body 200 of large area is formed.

Figure 3:
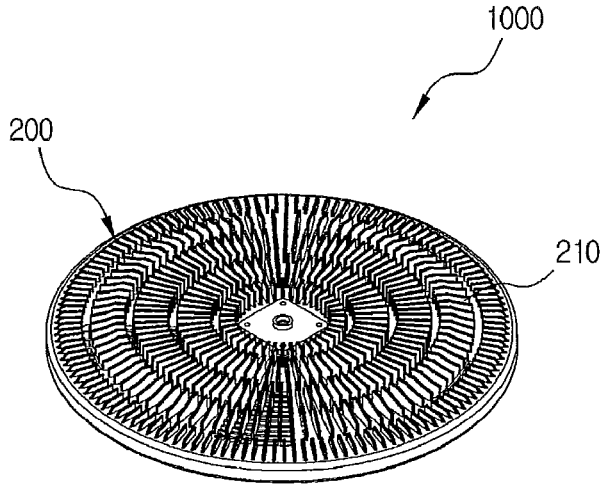
FIGS. 3 to 5 are a partial perspective view, disassembled perspective view and top-plan view of the lamp using LED according to the present invention.
Figure 4:
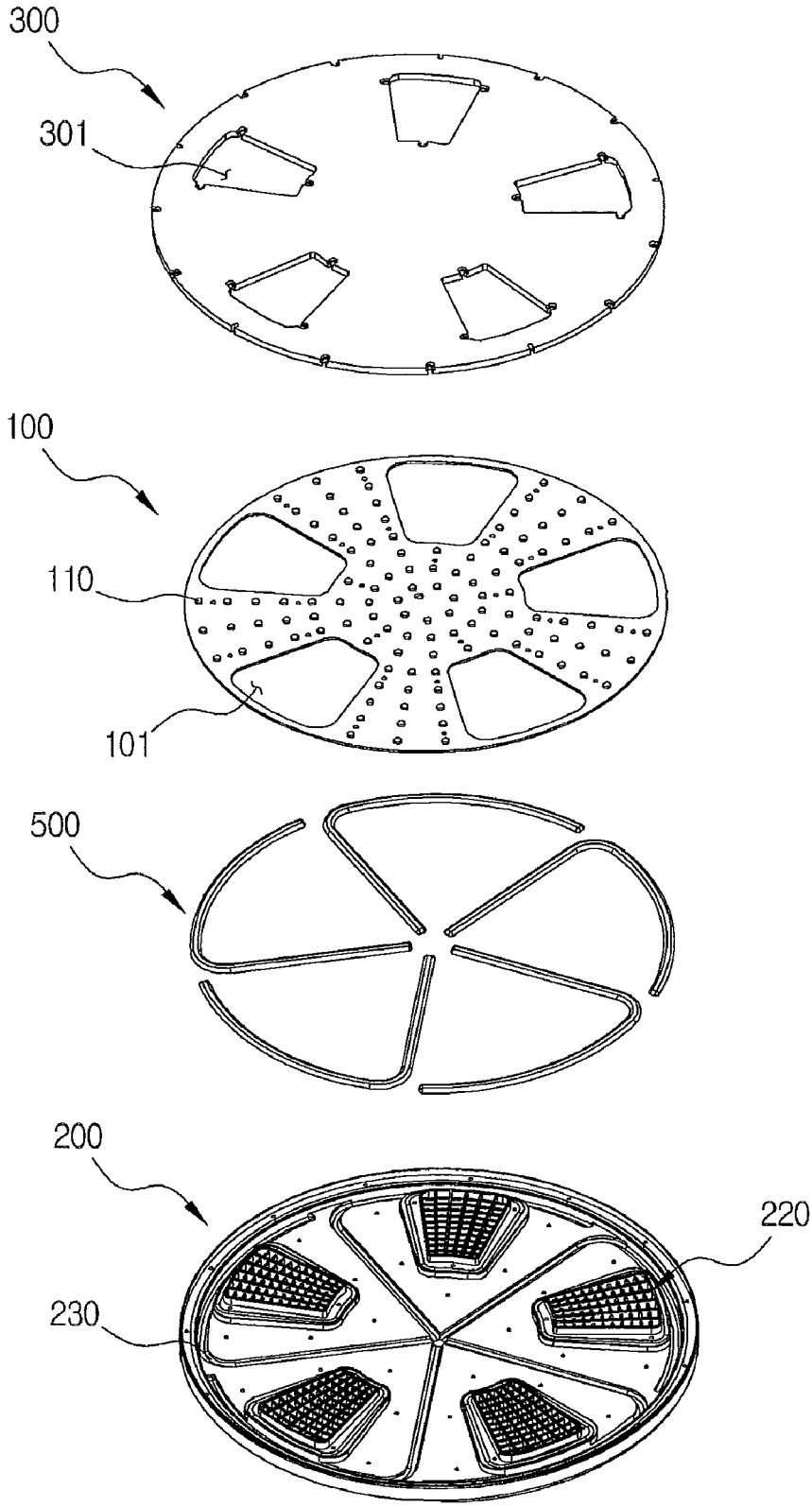
Figure 5:
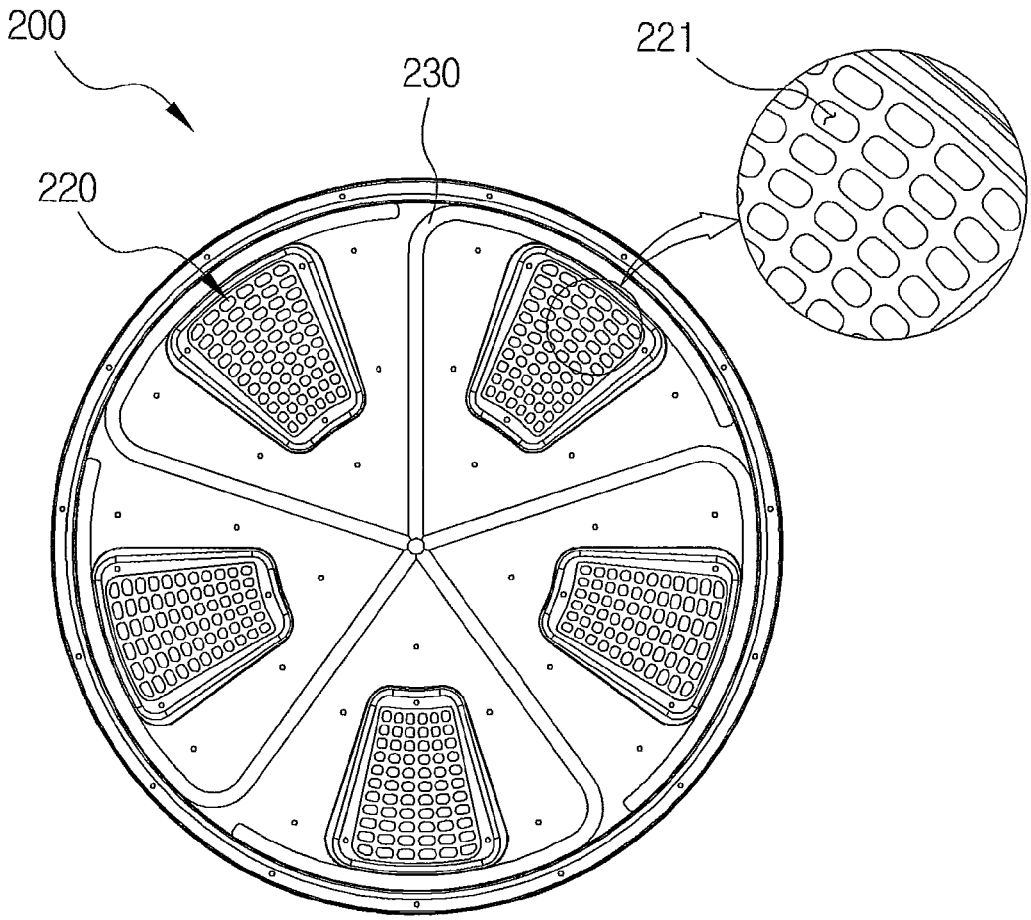

The heat pipe 500 can be equipped in various shapes and FIGS. 3 to 5 show an example that the heat pipe 500 is extended from the center part of the body 200 into the lateral direction so that it may be adjacent to the air-flowing part 220.

Figure 6:
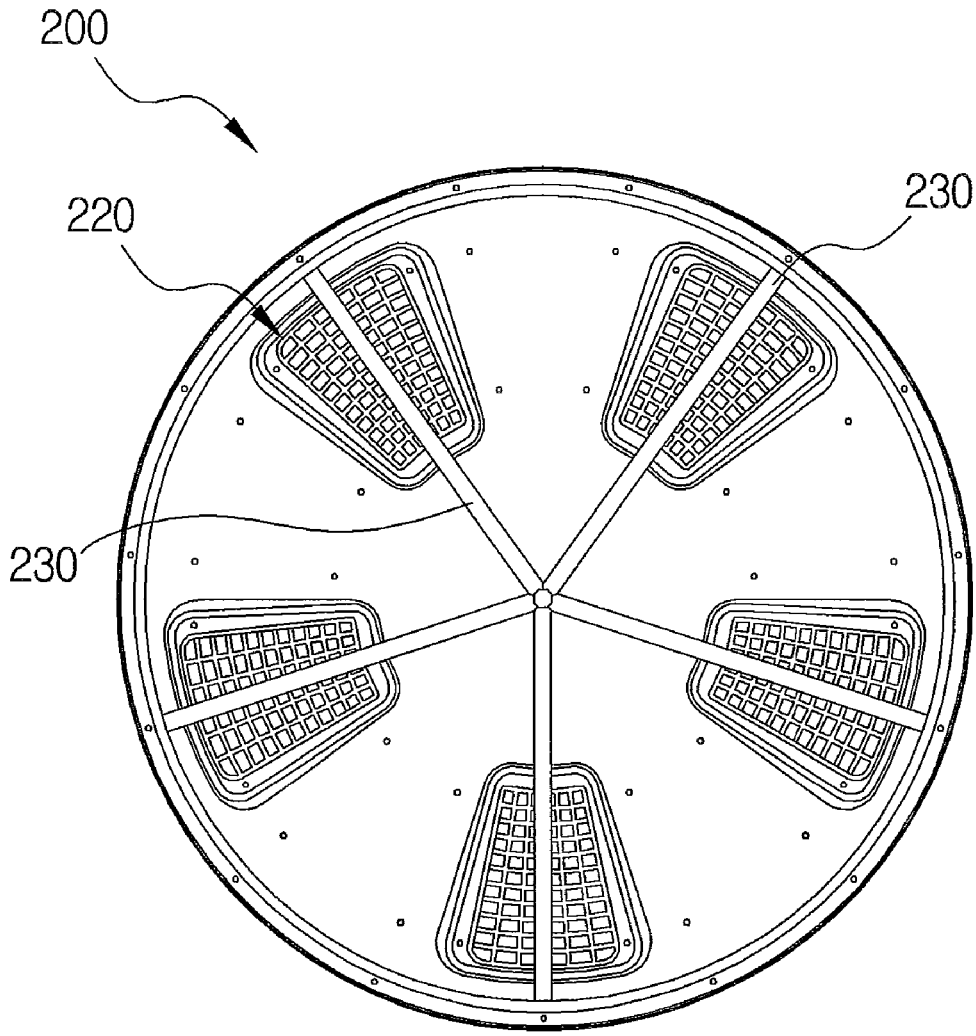
FIG. 6 is a drawing showing the other body type of the lamp using LED according to the present invention.

FIG. 6 shows an example that a predetermined area of the heat pipe 500 is located in the air-flowing part 220. It is shown that the heat pipe 500 is located to cause the air-flowing part 220 to be separated into two groups as shown. The lamp using LED 1000 according to the present invention includes, but not limited to this example, all examples of such a type that the predetermined area of the heat pipe 500 is located in the air-flowing part 220.

Since the air-flowing part 220 is located in the predetermined area of the heat pipe 500, the heat pipe 500 can be directly cooled by the air flowing through the air-flowing part 220 and therefore the temperature of the working fluid is lowered to enable the cooling performance to be improved.

Preferably, the body 200 has a setting part 230 of concave type formed to cause the heat pipe 500 to be set easily.

The body 200 is structured such that one side thereof is faced to the substrate 100, the setting part 230 is formed to set the heat pipe 500 on the one side of the body 200 faced to the substrate 100 and the heat sink 210 is formed on the other side to dissipate the heat easily.

If the heat pipe 500 is provided as shown in FIG. 6, the hollow-holes 221 composing the air-flowing part 220 are separated into two groups so that the heat pipe 500 may be easily set between two groups.

Subsequently, since the lamp using LED 1000 according to the present invention has the heat sink 210 and the air-flowing part 220 formed in the body 200 and further has the heat pipe 500, there are advantages that it is possible to ensure sufficient heat-dissipation performance, radiate the light stably by applying the light emitting diode 110 to the illuminating device of large scale and high output, and ensure even cooling throughout the lamp using LED 1000 to improve the durability.

Particularly, since the plurality of light emitting diodes 110 is provided in wide flat-type substrate, there is an advantage that applied to the high-output lamp using LED 1000.

According to the present invention, it is possible to provide a lamp using LED 1000 which has an air-flowing part formed in a body 200 and is equipped with a heat pipe 500 to make higher a heat-conductive efficiency and thereby to make higher a heat-generation performance considerably so that the light emitting diode 110 can be applied to a high-output illumination device to increase a life-time.

While the present invention has been described with respect to the specific embodiments, it will be apparent to those skilled in the art that various changes and modifications may be made without departing from the spirit and scope of the invention as defined in the following claims.

What is claimed is:

1. A lamp using LED, comprising:

a substrate in which a plurality of light emitting diodes is disposed at a predetermined distance and which has at least one first hollow-part formed by hollowing a predetermined region so that an air flows through it;

a body which has a heat sink provided in one side of the substrate to cause a heat generated from the light emitting diode to be transferred and an air-flowing part hollowed to correspond to the first hollow-part; and a protecting means which is attached to the body in the other side of the substrate to protect the substrate and has a second hollow-part hollowed to correspond to the first hollow-part and the air-flowing part.

2. The lamp using LED of claim 1, wherein the lamp using LED is formed with a holding means which holds the body to cause the air-flowing part to be communicated upward and downward.

3. The lamp using LED of claim 2, wherein the air-flowing part is formed with a plurality of hollow holes.

4. The lamp using LED of claim 3, wherein the lamp using LED is formed with a heat pipe which is provided between the body and the substrate.

5. The lamp using LED of claim 4, wherein the body has a concave-type setting part into which the heat pipe is set.

6. The lamp using LED of claim 5, wherein the heat pipe is formed adjacent to the air-flowing part.

7. The lamp using LED of claim 5, wherein a predetermined area of the heat pipe is located in the air-flowing part.

* * * * *